US007409753B2

(12) United States Patent
Li

(10) Patent No.: US 7,409,753 B2
(45) Date of Patent: Aug. 12, 2008

(54) METHOD FOR PRODUCING SPUNLACE NON-WOVEN CLOTH, METHOD FOR PRODUCING SPUNLACE NON-WOVEN CLOTH WITH X-RAY DETECTABLE ELEMENT, SPUNLACE NON-WOVEN CLOTH WITH X-RAY DETECTABLE ELEMENT PRODUCED THEREBY

(76) Inventor: Jianquan Li, Winner Industrial Park, Bulong Road, Longhua, Shenzhen 518109 (CN)

( * ) Notice: Subject to any disclaimer, the term of this patent is extended or adjusted under 35 U.S.C. 154(b) by 217 days.

(21) Appl. No.: 11/169,240

(22) Filed: Jun. 28, 2005

(65) Prior Publication Data

US 2007/0000064 A1 Jan. 4, 2007

(30) Foreign Application Priority Data

Feb. 6, 2005 (CN) ..... 2005 1 0033147
Mar. 17, 2005 (CN) ..... 2005 1 0033576

(51) Int. Cl.
*D01G 21/00* (2006.01)
*D04H 1/46* (2006.01)

(52) U.S. Cl. ..... 28/104; 28/167; 19/66 CC

(58) Field of Classification Search ..... 28/104, 28/105, 103, 101, 102, 165, 166, 167; 19/66 R, 19/200, 204, 66 CC, 98, 105, 65 A, 296, 19/115 R, 65 R; 8/101, 137, 138, 151
See application file for complete search history.

(56) References Cited

U.S. PATENT DOCUMENTS 3,747,161 A * 7/1973 Kalwaites ..... 28/105
3,802,030 A * 4/1974 Acree ..... 19/66 CC
4,960,630 A * 10/1990 Greenway et al. ..... 28/104
5,253,397 A 10/1993 Neveu et al.
5,393,304 A 2/1995 Vuillaume et al.
5,425,158 A 6/1995 Ripley
5,617,613 A * 4/1997 Ripley ..... 19/66 CC
5,849,647 A * 12/1998 Neveu ..... 442/381
6,378,179 B1 * 4/2002 Hirsch ..... 28/103
7,069,629 B2 * 7/2006 Burgess et al. ..... 28/104
2003/0124942 A1 * 7/2003 Fuller et al. ..... 442/408

FOREIGN PATENT DOCUMENTS

EP 0132028 A2 1/1985
EP 0160560 11/1985
WO WO 03/031710 A1 4/2003

* cited by examiner

*Primary Examiner*—Amy B Vanatta
(74) *Attorney, Agent, or Firm*—Knobbe Martens Olson & Bear LLP

(57) ABSTRACT

A method for producing spunlace non-woven cloth includes the following steps: clearing cotton—carding—spreading the web—water jetting—bleaching—drying—rolling the finished products. This method improves the good ratio of the finished products of the whole procedure, reduces the producing cost, economizes raw materials and save the power as well as reduces the impurity content of products and ensures the hygiene of finished products and greatly reduces the bacteria content. Moreover, the direct products of the present invention have the advantages of being soft, having good skin tolerance, no toxic, no stimulation, no sensibility, having good absorbency, convenient and comfortable to use.

10 Claims, 2 Drawing Sheets

METHOD FOR PRODUCING SPUNLACE NON-WOVEN CLOTH, METHOD FOR PRODUCING SPUNLACE NON-WOVEN CLOTH WITH X-RAY DETECTABLE ELEMENT, SPUNLACE NON-WOVEN CLOTH WITH X-RAY DETECTABLE ELEMENT PRODUCED THEREBY

FIELD OF THE INVENTION

The present invention relates to a method for producing 100% cotton spunlace non-woven cloth and 100% cotton mixed with synthetic fibers spunlace non-woven cloth, a method for producing spunlace non-woven cloth with X-Ray detectable element and spunlace non-woven cloth with X-Ray detectable element produced by such method.

BACKGROUND OF THE INVENTION

At present, medical non-woven cloth is made of synthetic fiber. The components of synthetic fiber are commonly 70% Rayon and 30% Polyester (these are coming from petroleum). The raw material resources are non-renewable, the production cost is high, after using, the destroying cost is high, and it damages the environment. At the same time, some patients are sensitive to this material. Therefore the prospect of synthetic fiber non-woven medical dressing is not optimistic. However, the nature spunlace non-woven cloth medical dressing will be widely used, because the raw material of this non-woven cloth is naturally planted cotton; the raw materials are abundant and recycled. It is simply dealt with, as well as being soft, protecting environment, having good absorbency, no toxic, no stimulation, no sensibility, being convenient and comfortable to use. At present, the method for producing spunlace non-woven cloth is, clearing cotton—degreasing—bleaching—drying—carding cotton—spreading the web—water jetting—drying—rolling the finished products. The disadvantages of this producing method are with more procedures, high cost and bigger waste of power. As this producing method is degreasing and bleaching the cotton fiber first, therefore the cotton fiber is not smooth, and it is difficult to spread fiber into the web. With this method, the impurity content of finished products is high, so the quality cannot be guaranteed. In a word, it is much more wasteful by this process, the good ratio of finished products is low, and the production cost is high, therefore the price is terribly high. In this case, till today, this type of spunlace non-woven cloth is not used widely.

In the medical trade gradually uses more and more non-woven cloth. The non-woven cloth is folded in multi layered dressing to use in hemostasia, examining blood, sucking blood or body fluid in operation. In operations, the dressings are dropped in human body because of subjective or objective reasons. And the dressings which are soaked with blood or body fluid have the similar color with the body tissue in human body or in the wound, which is hard to discover. Therefore they are difficult to discover so that they are left over in the human body. Moreover, they are difficult to be checked out after the wound is sewn up, unless cutting the seam again. Leaving the dressings in the human body is a very dangerous accident. If it cannot be checked out in time and be cleared, it will cause worse of patient's condition and even death. The disadvantage of present non-woven is that when they are left over in the human body, they are difficult to be checked out.

SUMMARY OF THE INVENTION

Accordingly, a primary objective of the present invention is to provide a method for producing spunlace non-woven, as well as reduce the consuming of energy sources, cut down the producing cost and decrease the impurity content of products to enable the hygiene of finished products and greatly reduce the bacteria content of products.

Another object of the present invention is to provide a method for producing water-jet non-woven that can be detected by X-Ray machine, which makes the spunlace non-woven can be irradiated by X-Ray machine and accurately detected the position and size of the leftover as well as removed immediately in case of being left over in the body of patients.

Still another object of the present invention is to provide a kind of producing method of spunlace non-woven that can be detected by X-Ray machine, which makes the X-ray detectable elements and non-woven cloth combine firmly and reliably, as well as being easy to use and no negative effect.

The further object of the present invention is to provide a kind of non-woven which can be detected by X-Ray machine. The producing cost of this non-woven is low and can make sure the X-ray detectable element will not break off and the quality is good.

For attaining the above-mentioned object, A method for producing spunlace non-woven cloth, A method for producing spunlace non-woven cloth with X-Ray detectable element, spunlace non-woven cloth with X-Ray detectable element thereby are featured as follows:

A method for producing spunlace non-woven cloth comprised the following steps in sequence:

A, clearing cotton: Loose the raw materials, get rid of impurity and mix;

B, carding: Further get rid of impurity, clear and card the fiber smoothly;

C, Spreading the web: For the fiber which has been carded, reciprocated and intervened or overlapped spreading the web according to direction of fiber;

D, Water jetting: Employ jets of water at high pressure to puncture the fiber web, to entangle the cotton web.

E, Degreasing: Remove the waxiness or grease from the non-woven cloth after water jetting;

F, Bleaching: Bleach the spunlace non-woven cloth according to the requirements of pharmacopoeia to make it meet the medical standard.

F, Rolling the finished products.

Before the water jetting procedure, the raw materials used have not been degreased.

The raw materials mentioned are pure cotton or cotton adds chemical fiber, for example, cotton adds polyester, cotton adds synthetic cotton, cotton adds viscose, cotton adds polypropylene fiber, cotton adds wood pulp fiber, etc.

Before clearing cotton there also can be a procedure which makes simple water treatment and boiling treatment on the above stated pure cotton or synthetic cotton.

To make optimum choose, the carding comprises the following steps:

1) loosing: Loose the raw materials to make into single fiber, making them enter the carding machine smoothly;

2) carding cotton: Continuously carry on one time or more times of carding on the single fiber, to remove the foreign materials, for example, cotton shells, etc.

For the present technology craftwork, as before water jetting only the procedure of clearing cotton has the function of removing impurity, the pressure of removing impurity in water jetting procedure is increased and impurity is apt to remain. In addition, there is no procedure to clear the relatively short and bad cotton fibers in the present technology. And the water jetting can only remove some cotton knots rather than remove short fibers. As a result, in the last tension test the relatively short and bad cotton fibers will cause the whole product not to meet the medical standard because they have small tension. The present invention adds carding procedure after clearing cotton. It uses carding machine to card the raw cotton to further remove impurity and select the superior, to remove some exiguous impurities (including cotton knots) and improve the cleanliness of products as well as clear and filter the relatively short and bad cotton fibers. This can ensure the fiber tension of cotton web entering the next procedure, therefore reducing the rejecting rate caused by defects of impurity, tensile force and so on in the latter procedure, that is, reducing the defect ratio of the products of the whole procedure.

The disadvantage of the prior art is that it degreases bleaches and dries the raw cotton after simple cleaning cotton, that is, to bleach all the sundries and impurities. Thus the characteristic of this bleaching craft is that it consumes too much energy, the cost is too high, and the unwanted 15-18% of the impurities are also bleached. The second aspect is that hygiene is the most important for medical dressings, but the process that first degreases and bleaches the cotton, later clears cotton, spreads web and water jets pollutes cotton another time. At the same time, in the present technology it is to degrease first and then water jet, so the absorbability of bleached cotton web is strengthened; as there are many exiguous impurities in the cotton web and these impurities are absorbed by the cotton webs that have strong absorbability after degreasing, so they are not easily rinsed out even in water jetting. The present invention rearranges the sequence of degreasing and water-jetting procedure, that is, to first water jet and then degrease. The raw material used before water jetting is purely natural cotton which has been not degreased and bleached. Can first remove the exiguous impurities in the cotton web and then degrease, which avoids the problem that the exiguous impurities are absorbed and not easily removed. This further improves the cleanliness of products and reduces the scrap ratio or rework ratio because of containing impurity.

Therefore the present invention not only reduces the procedures, but also improves the finish goods ratio of the whole procedure, accordingly reduce the producing cost and economize energy sources.

In order to achieve the above object, the present invention provides a method for producing spunlace non-woven cloth with X-Ray detectable elements comprises the following procedures: crossly spreading the web, water jetting, degreasing and rolling the finished products. And before rolling the finished products, plant or spray the X-ray detectable elements which can be detected by X-ray machine into the fiber web or onto the surface of fiber web of non-woven, or heat on the surface of spunlace non-woven cloth.

The above method for producing spunlace non-woven cloth with X-Ray detectable elements includes the following detailed procedures in sequence: clearing cotton—carding—spreading the web—water jetting—bleaching—drying—rolling the finished products. Specially, before water jetting, plant or spray the X-Ray detectable element threads into the fiber web or onto the surface of fiber web. Then make them into non-woven cloth with X-Ray or X-Ray detectable elements through water jetting, degreasing and bleaching. The prefer method is: in the procedure of crossly spreading the web, uniformly plant or spray the one piece or more pieces of X-Ray detectable element threads into the fiber web or onto the surface of fiber web. Then make them into non-woven cloth with X-Ray or X-Ray detectable elements through water jetting, degreasing and bleaching.

The method for planting or spraying the X-Ray detectable element onto the surface of fiber web includes the following procedures in sequence: clearing cotton—carding—spreading the web—water jetting—bleaching—drying—rolling the finished products. Specially, after water jetting, heat the X-Ray or X-Ray detectable elements onto the surface of non-woven. The prefer method is: after water jetting, uniformly heat one piece or more pieces of X-Ray detectable element threads on the surface of fiber web. Then make them into non-woven cloth with X-ray or X-Ray detectable elements through degreasing and bleaching. Said X-Ray detectable elements are X-Ray detectable element threads or X-Ray detectable element slices shaped as lines or tapes.

In order to achieve the above object, the present invention also provides a kind of spunlace non-woven cloth with X-Ray detectable elements, which comprises fiber web and X-Ray detectable elements that can be detected by X-Ray machine. The X-Ray detectable elements mentioned tangle with the single fiber in the cotton fiber web. Fiber web refers to the cotton fiber web formed by pure cotton or the fiber web mixedly formed by cotton adding a small part of synthetic fiber.

Further, the mentioned X-ray detectable elements are detectable element threads shaped as lines or tapes. There is at least one piece of X-Ray detectable element thread.

The present invention provides reliable assurance for using pure cotton or synthetic cotton non-woven at ease in the future. And also it resolves the problem of adding X-Ray or X-Ray detectable elements at the same time of producing non-woven, thus avoiding the additional procedure of adding X-Ray or X-Ray detectable elements when producing finished products. The present invention improves the quality of products or goods, and reduces elementary polluting bacteria of the finished products, which is really the biggest quality assurance for medical sterile products. The simultaneous finish of non-woven production and adding of X-Ray detectable elements reduces the stretch and out of shape of non-woven and form of flying wadding because of additional procedure and ensure the appearance quality of the products. Before water jetting, plant or spray the X-Ray detectable element threads to the fiber web. After the water jetting procedure, the X-ray detectable element threads and cotton fiber or synthetic fiber tangle together, thereby making the X-ray detectable element threads not easily break off and break down, which improves the safety of products or goods.

The invention, together with other objects and advantages thereof, will be best understood by reference to the following description taken in conjunction with the accompanying drawings:

DETAILED DESCRIPTION OF PREFERRED EMBODIMENTS

Figure 1:
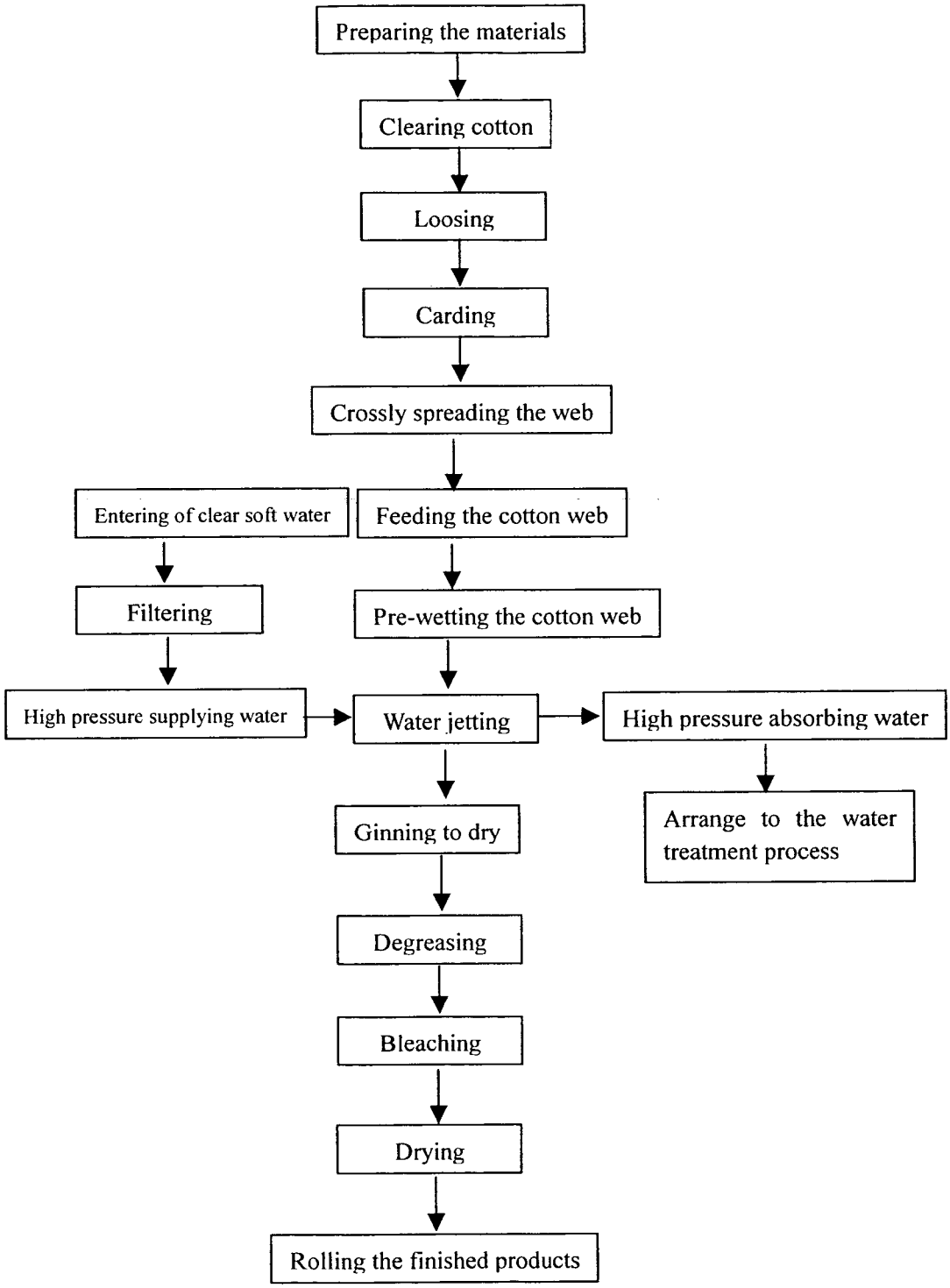
FIG. 1 is a producing procedure flow chart of a embodiment of the present invention.

Referring to FIG. 1, the manufacturing procedure of spunlace non-woven medical dressing comprises the following steps:

1) preparing the materials: Prepare the raw materials, namely 100% natural cotton or a small part of synthetic fiber adding natural cotton;

2) clearing cotton: First remove impurity of raw materials with cotton clearing machine to sift the foreign materials in the raw materials and loose the raw materials. This procedure is an acknowledged technology and it is the same with the present technology;

3) carding: It includes loosing and carding cotton. Loosing is to loose the raw cotton after clearing cotton with carding machine to make into single fiber state. This is necessary for removing small impurities and carding cotton. Carding cotton is to comb the single fiber smoothly with carding machines according to the lengthways of raw cotton fiber to make the tensile force between fibers exert to the biggest. At the same time, small impurities (such as cotton knots) and short fibers in the raw cotton will be filtered in the process of carding. The task of removing impurities is mainly taken by puncturing roller part. It can remove 50% to 60% of impurities fed in cotton layer. Another small part of dust enters cotton covering board to be removed or fall in other parts. In the process of carding, long fibers and tin forest needle tooth are exposed to many areas, so they are easy to be taken away by the tin forest needle tooth; whereas short flosses and fibers often stay on the cover board needle tooth and are pressed into the needle tooth, and form cover board cotton then being removed. In order to further remove impurities, short flosses and fibers, as a preferred embodiment of the present invention, the carding of this procedure includes one time, two times or more times of carding cotton depending on specific products.

4) Crossly spreading the web: For the fiber which has been preliminarily carded, reciprocated and intervened overlapped spreading the web depending on the direction of fiber according to the requirements of grammage specifications of products. The main purpose is to strengthen the tension between fibers (including cotton or synthetic fibers) and ensure the tensile strength of the ultimate finished products.

5) feeding the fiber web: Fiber web includes cotton web, and the web which is composed of cotton and synthetic fiber;

6) Pre-wetting the fiber web: To make sure a good moist condition before water jetting;

7) water jetting: Employ the high pressure water needle of water jet machine to produce jet of water at high pressure to make obverse and inverse water jetting to the fiber web, which enables the fibers in the fiber web to fully tangle, further reinforce the tension between fibers and improve the tensile strength of the ultimate finished products. At the same time, the small impurities (including cotton knots) are eliminated, purity is further improved and the good ratio of products is improved. This procedure carries on one time, two times or more times of water jetting according to the different purposes of products. When water jetting for two times, rubbing may produce flosses in the course of using. The more times of water jetting, the better is the shaping of products and tension of fiber; however, if the time of water jetting is too much, the production cost will be increased, and as to the water jetting of more than three times the effect is very small. Therefore, as the preferred embodiment of the present invention, the water jetting of this procedure contains 1 to 3 times. The water jet machines used are web-leveling water jet machine and round drum water jet machine. The web-leveling water jet machine and round drum water jet machine can be alternately used, and can also be continuously used. For example, when water jetting for 3 times, the water jet machine in the first time of water jetting is web-leveling water jet machine, in the second time is round drum water jet machine, and in the third time is web-leveling water jet machine. The cotton webs pass three water jet machines one after the other in the equal speed. Different speeds are set according to the thickness of cotton web. For different specifications of products, the pressure of water jetting is also different, which is commonly controlled at about 120 $Kg/cm^2$. The distance of spunlaces is within 1.8 m. Water jetting of three times can further make sure the good shape of appearance, thus resolves the bad shaping of the traditional spunlace non-woven medical dressing and very well deal with the problem that rubbing may produce flosses in the course of using products.

8) ginning to dry: Extrude the water in the fiber web after water jetting to make the next procedure convenient;

9) degreasing: Remove the waxiness or grease on the cotton fiber to strengthen the water absorbency of products. This procedure is the same with the degreasing procedure of the present technology.

10) bleaching: Improve the whiteness of the raw cotton fiber. This procedure is the same with the bleaching procedure of the present technology.

11) drying;

12) rolling the finished products.

In sum, the key point of the present invention is that for the first time it directly uses the raw materials which have not been degreased and bleached in the production of non-woven cloth. It breaks the traditional procedures and boldly adopts the most advanced carding technology aiming at cotton, which is to first make into spunlace non-woven cloth and then carry on degreasing and bleaching. This reduces the impurity content and improves the tensile strength of products, thus improving the qualification rate of the finished products, reducing the working procedures, greatly economizing the energy consumption and cutting down the production cost. Besides, the main raw material of the direct products of the present invention is purely natural cotton, so they have the advantages of being soft, having good skin tolerance, no toxic, no stimulation, no sensibility, having good absorbency, convenient and comfortable to use.

Figure 2:
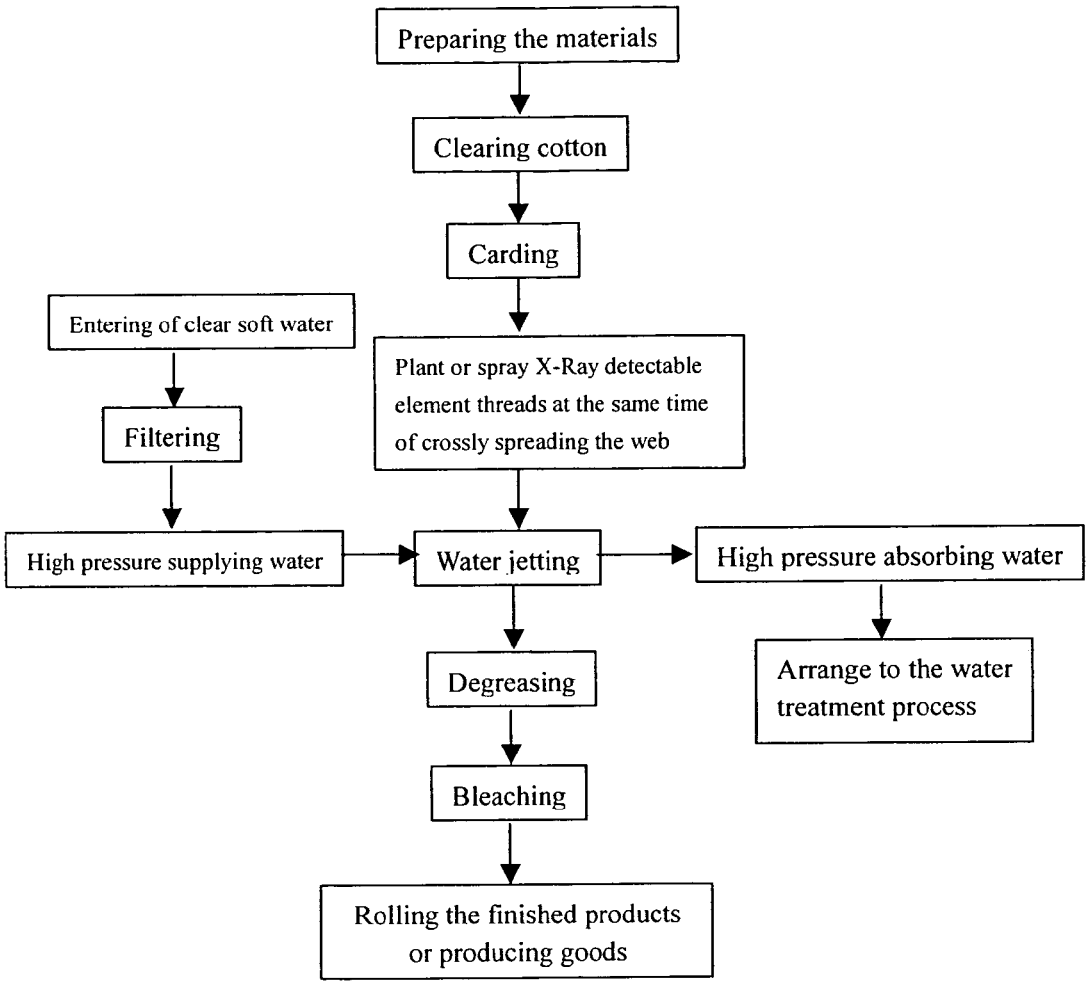
FIG. 2 is a producing procedure flow chart of a preferred embodiment of the present invention.

Referring to FIG. 2, that is the preferred embodiment of a method for producing spunlace non-woven cloth with X-Ray or X-Ray detectable elements. The producing procedure of spunlace non-woven cloth with X-Ray or X-Ray detectable elements comprises the following steps:

1) preparing the materials: The same with the above embodiment.

2) clearing cotton: The same with the above embodiment.

3) carding: The same with the above embodiment.

4) crossly spreading the web: At the same time of spreading the web, uniformly plant or spray the X-Ray detectable element threads as shaped solid line state with compressed gas to the process of spreading web; or spray the liquid X-Ray absorbing materials to the process of spreading web, to solidify into the X-ray detectable element threads. At the same time, for the fiber which has been preliminarily carded, reciprocated, intervened or overlapped spreading the web depending on direction of fiber according to the requirements of grammage specifications of products. X-ray detectable element threads can be planted or sprayed in the middle of fiber web, and can also be placed on the surface of fiber web.

5) water jetting: The same with the above embodiments.

6) degreasing;

7) bleaching;

8) rolling the finished products.

X-Ray detectable elements refer to substances which are made of X-Ray absorbing materials or can be detected by X-Ray machine. They can be shaped as thread, tape, block or slice.

Figure 3:
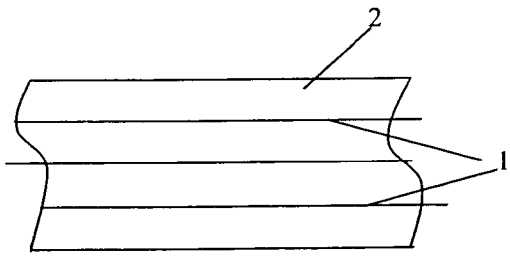
FIG. 3 is the product sketch map which adding X-Ray detectable element threads when crossly spreading the web in the present invention.

Referring to FIG. 3, the products sketch map after adding X-Ray detectable element threads in crossly spreading the web. X-ray detectable element thread 1 locates in the fiber web 2 or on the surface of fiber web 2 uniformly or in the equal space between, X-Ray detectable element thread 1 should have at least one piece. The number of X-Ray detectable element thread 1 can vary according to requirements, to make sure that each medical dressing has X-ray detectable element thread on it. After water jetting, X-ray detectable element thread 1 tangle up with the single fiber in the fiber web 2, so the X-ray detectable element threads are not easily broken off and broken down.

The main component of X-Ray detectable element thread is barium sulphate. It mixes with chemical fiber, cotton fiber or nonpoisonous plastics to make into X-Ray detectable element thread. X-Ray detectable element threads can also be made of other X-Ray absorbing materials.

This embodiment is to first water jet and then degrease, which is different from the prior procedure of non-woven cloth (the prior procedure is to first deal with raw materials and then water jet, and the finished products form after water jetting). The producing method of this embodiment can first eliminate the small impurities in the cotton web and then degrease, thus avoiding the problem that the small impurities are not easily eliminated because they are absorbed by cotton fibers after degreasing, which further improves the cleanliness of products, decreases the probability of scrapping or doing over again because of containing impurity and reduces production cost.

The X-Ray detectable element threads can also be added in the procedure of crossly spreading the web, and can also be added after water jetting. It includes the following steps:

1) Preparing the materials; The same with the above embodiment.

2) Clearing cotton; The same with the above embodiment.

3) Carding; The same with the above embodiment.

4) Spreading the web; The same with the above embodiment.

5) Water jetting; The same with the above embodiment.

6) Heat the X-ray detectable element threads to the surface of non-woven cloth. The heat refers to make hot heating, hot pressing and ultrasonic wave treatment to the X-ray detectable element threads and stick them to the surface of non-woven cloth.

7) Degreasing; The same with the above embodiment.

8) Bleaching; The same with the above embodiment.

9) Rolling the finished products.

What is claimed is:

1. A method for producing spunlace non-woven cloth comprising the following steps in the following sequence A-F:

A. clearing cotton by loosening raw materials and removing impurities;

B. carding the cotton to further remove impurities and sort out bad cotton fibers;

C. spreading a web according to a direction in which the fibers extend;

D. water jetting the web by applying jets of water at high pressure to entangle the web;

E. degreasing the web by removing waxiness or grease from the cotton fibers after water jetting; and F. bleaching the web.

2. The method for producing spunlace non-woven cloth according to claim 1, wherein the raw materials have not been degreased or bleached prior to said water jetting.

3. The method for producing spunlace non-woven cloth according to claim 2, wherein said raw materials consist of cotton products.

4. The method for producing spunlace non-woven cloth according to claim 3, wherein prior to the clearing said raw materials are treated with cold or warm water.

5. The method for producing spunlace non-woven cloth according to claim 1, wherein said carding the cotton comprises:

1) loosening the cotton by clearing and loosening the raw materials to make them into single fibers, so as to make the fibers enter a carding machine smoothly;

2) carding single fibers at least once to remove foreign materials.

6. The method for producing spunlace non-woven cloth according to claim 1, wherein said water jetting is performed a predetermined number of times.

7. The method for producing spunlace non-woven cloth according to claim 6, wherein said water jetting is performed using a water jet machine selected from mesh-leveling water jet and round drum water jet parts.

8. The method for producing spunlace non-woven cloth according to claim 7, wherein said mesh-leveling water jet and round drum water jet parts are alternately used.

9. The method for producing spunlace non-woven cloth according to claim 1, wherein the raw materials comprise a few percentage synthetic fibers.

10. The method for producing spunlace non-woven cloth according to claim 1, further comprising a step of rolling the web subsequent to bleaching.

* * * * *